US009806403B2

(12) United States Patent
Braubach

(10) Patent No.: US 9,806,403 B2
(45) Date of Patent: Oct. 31, 2017

(54) SPACE-BORNE ANTENNA SYSTEM

(71) Applicant: Airbus DS GmbH, Taufkirchen (DE)

(72) Inventor: Harald Braubach, Bermatingen (DE)

(73) Assignee: Airbus DS GmbH, Taufkirchen (DE)

( * ) Notice: Subject to any disclaimer, the term of this patent is extended or adjusted under 35 U.S.C. 154(b) by 226 days.

(21) Appl. No.: 14/514,431

(22) Filed: Oct. 15, 2014

(65) Prior Publication Data

US 2015/0102975 A1 Apr. 16, 2015

(30) Foreign Application Priority Data

Oct. 16, 2013 (EP) ..... 13004944

(51) Int. Cl.

| | |
|---|---|
| ***H01Q 21/00*** | (2006.01) |
| ***H01Q 1/28*** | (2006.01) |
| ***H01Q 1/50*** | (2006.01) |
| ***H01Q 1/08*** | (2006.01) |
| ***H01Q 1/52*** | (2006.01) |

(52) U.S. Cl.

CPC ..... *H01Q 1/288* (2013.01); *H01Q 1/084* (2013.01); *H01Q 1/50* (2013.01); *H01Q 1/52* (2013.01); *H01Q 21/0006* (2013.01)

(58) Field of Classification Search

USPC ..... 343/772, 853, 702; 333/254

See application file for complete search history.

(56) References Cited

U.S. PATENT DOCUMENTS 5,629,657 A * 5/1997 Bayorgeon ..... H01P 1/042 333/254

OTHER PUBLICATIONS

Extended European Search Report dated Jan. 8, 2014 (seven (7) pages).

(Continued)

*Primary Examiner* — Jessica Han
*Assistant Examiner* — Hai Tran
(74) *Attorney, Agent, or Firm* — Crowell & Moring LLP

(57) ABSTRACT

A space-borne antenna system includes a number of panels being moveable to each other and having a gap in between them when the panels are arranged in an operation condition. The system also includes an RF distribution network for providing transmit signals to the number of panels and combining received signals from the number of panels. The system further includes a set of choke flange assemblies that allow a contactless inter-panel signal transmission across a dedicated gap. A respective choke flange assembly is arranged on the far side of a radiating surface of the dedicated adjacent panels. The system also includes an RF seal assembly for suppressing a signal coupling of signals radiated from the number of panels to the set of choke flange assemblies by sealing the gap.

13 Claims, 3 Drawing Sheets

(56) References Cited

OTHER PUBLICATIONS

Petersson et al., "Radiation performance of the ERS-1 SAR EM antenna," Antennas and Propagation Society International Symposium, 1988, pp. 212-215, vol. 1 (XP032358218).
Cowles, "ERS-1 and Radarsat SAR Antennas: A Comparison of Technologies," Microwave Engineering Europe, 1991, pp. 37, 38, 40, and 41 (XP000252415).
Capece et al., "Current activities on SAR antennas at AAS-I," First European Conference on Antennas and Propagation, 2006, IEEE (seven (7) pages) (XP031393555).
Ostergaard et al., "C-band SAR for the GMES Sentinel-1 mission," Radar Conference (EURAD), 2011, pp. 234-240, IEEE (XP032070486).
Cowles et al., "Engineering and design of the Radarsat SAR antenna radiating panels assemblies," Seventh International Conference on Antennas and Propagation, 1991, pp. 563-566, IEE (XP006516523).

* cited by examiner

SPACE-BORNE ANTENNA SYSTEM

CROSS-REFERENCE TO RELATED APPLICATIONS

The present application claims priority under 35 U.S.C. §119 to European patent application number 13 004 944.8-1812, filed Oct. 16, 2013, the entire disclosure of which is herein expressly incorporated by reference.

BACKGROUND AND SUMMARY OF THE INVENTION

Exemplary embodiments of the invention relate to a space-borne antenna system, comprising a number or panels being moveable to each other and having a gap in between them when the panels are arranged in an operation condition. The antenna system further comprises a RF distribution network for providing transmit signals to the number of panels and combining received signals from the number of panels and a set of choke flange assemblies which allow a contactless inter-panel signal transmission across a dedicated gap, wherein a respective choke flange assembly is arranged on the far side of a radiating surface of the dedicated adjacent panels.

Antenna systems for space applications are deployed in space while they are folded for transportation. After having deployed the antenna system it is necessary to couple adjacent panels of the antenna system for signal transmission.

An antenna system of the type above is, for example, the Sentinel-1 SAR Antenna Subsystem (SAS) for the Sentinel-1 mission. This antenna system is a deployable planar active phased array antenna working in C-band (5.405 GHz) with a frequency bandwidth of 100 MHz. The antenna has an overall size of 12.3 m×0.84 m and is formed by a central panel mounted on top of the spacecraft and two antenna side wings at the two adjacent sides of the spacecraft. The central panel is equipped with two SAS tiles, whereas the two panels of each side wing carry three SAS tiles each. This leads to an overall number of 14 identical tiles: 6 (SAS right wing)+2 (SAS central panel)+6 (SAS left wing). Each SAS tile possesses all the functions needed to allow for beam shaping and steering.

Generally, the SAS encompasses the following principal functionalities: signal radiation and reception (WG-Assy); distributed transmit signal high power amplification (EFEs, TAAs); distributed receive signal low noise amplification with LNA protection (EFEs); signal and power distribution (corporate feed, power converter) (RFDN); phase and amplitude control including temperature compensation (EFEs via TCU); internal calibration loop; deployment mechanisms including hold down and release; and antenna mechanical structure.

Regarding the RF-signal power distribution, on panel level the Sentinel-1 SAR Instrument RF-Distribution Network (RFDN) distributes in TX the signals from the SAR Electronic Subsystem (SES) to the antenna tiles (i.e. to the input port of the Tile Amplifier Assembly (TAA)) with a good phase match. On SAS tile level the RFDN distributes the TX signals from the output of the tile amplifier assembly to the Electronic Front End (EFE) modules with a good phase match. For RX the RFDN combines the received signal in the reverse direction.

The RF-Distribution Network is made up of the following elements:

- the Azimuth Plane Distribution Network (APDN), for panel level signal distribution
- the Elevation Plane Distribution Network (EPDN), for SAS tile level signal distribution
- the RF harness In summary, the RFDN possesses the following major functions:

- For TX: Distribute the TX signal from the SES via the tile amplifiers to the EFEs with a small phase variation between the output ports.
- For RX: Combine the received signal from the EFEs via the tile amplifiers towards the SES with a small phase variation between the different RX paths.
- Band pass filtering in the TX and RX path.

On tile level, the EPDN of the RFDN consists of coaxial cables and power dividers/combiners. On panel level, the APDN encompasses coaxial cables and power divider/combiner composite as well. For the Inter-Panel RF Harness routing, connection of the three RF harness branches (TX, RX-V and RX-H) from panel to panel after deployment is achieved by a set of dedicated choke flange connections, which allow a contactless inter-panel signal transmission. The choke flange assemblies are located in the center of the Antenna Panel Frame (APF) transverse beam.

It has been found in tests that a high amplitude ripple in transmit calibration mode (TX Cal) occurs for horizontal polarized signals. This makes it difficult to conduct an internal calibration.

Accordingly, exemplary embodiments of the present invention are directed to an antenna system in which an internal calibration can be made easier and more reliable.

In order to improve internal calibration, a space-borne antenna system is disclosed, which comprises a number or panels being moveable to each other and having a gap in between them when the panels are arranged in an operation condition; an RF distribution network for providing transmit signals to the number of panels and combining received signals from the number of panels; and a set of choke flange assemblies which allow a contactless inter-panel signal transmission across a dedicated gap, wherein a respective choke flange assembly is arranged on the far side of a radiating surface of the dedicated adjacent panels. Furthermore, the antenna system comprises an RF (radio frequency) seal assembly for suppressing a signal coupling of signals radiated from the number of panels to the set of choke flange assemblies by sealing the gap.

The invention is based on the consideration that the high amplitude ripple in transmit mode that occurs for horizontal polarized signals is a result of coupling from the antenna waveguide radiators to the choke flange assembly between two panels. An RF seal is added to the junction between two adjacent panels to minimize the coupling from waveguide radiators to the choke flange assembly. The added seal is made such that it does not counter-act to a panel latching mechanism. Hence, the RF seal is provided in a way to not exert excessive additional mechanical force while it does not require mechanical contact between the panels. As a result, the RF seal assembly closes the gaps between panels, specifically tiles between two adjacent panels.

According to a further embodiment a respective RF seal assembly is dedicated to a gap between two adjacent panels of the number of panels.

A respective RF seal assembly may comprise a first and a second seal profile that are affixed in opposing pairs in the gap between two adjacent panels of the number of panels. The profiles enable closing the gap between the panels, specifically tiles within the panels.

The first and the second seal profile may have an L-shaped cross-section, in a side view in a longitudinal section through the antenna system. First portions of the first and the second seal profile extend in a plane of the number of panels, when the panels are arranged in an operation condition, and are attached to the dedicated adjacent panel. Second portions of the first and the second seal profile extend in a direction of radiation of signals such that they are opposing and having a gap in between them. This shape, on the one hand, enables closing the gap between the panels. On the other hand, it does not count to a panel latching mechanism.

In one embodiment, the gap between the second portions of the first and the second seal profile has a constant width in a direction of radiation of signals. In this configuration, the second seal profiles are perpendicular to the plane of the panels, when the panels are arranged in an operation condition, i.e., the angle between the first and the second portion of a respective profile is 90°.

In an alternative embodiment, the gap between the second portions of the first and the second seal profile has a widening or a narrowing width in a direction of radiation of signals, resulting in an angle between the first and the second portion of a respective profile which is less or r more than 90°.

It is preferred that the RF seal assembly is made from the material of radiating waveguides of the set of panels. This ensures that the RF seal assembly and the waveguides have the same coefficients of thermal expansion resulting in minimized therm-mechanical stress. The profiles of the RF seal assembly may be made from CFRP, in particular metallized CFRP. CFRP is a Carbon fiber reinforced plastic. This allows manufacturing the profiles from left-over antenna waveguides. Alternatively, the RF seal assembly may be made from a metal, e.g. aluminum.

In a further preferred embodiment, the RF seal assembly is mechanically attached to the adjacent panels via at least one adhesive tape, in particular a high adhesive double sided tape. As one of the adhesive tapes, for example, 3M #Y966 tape may be used. Such kind of tape is used for heavy duty hold down applications where a high level of adhesion is required.

In a further preferred embodiment, the RF seal assembly is electrically coupled to the adjacent panels via a metal adhesive tape. The metal adhesive tape may be, for example, a Cho-foil, which has good shielding and conductivity properties with respect to EMI (Electro-magnetic Interference). This assists suppressing the signal coupling of signals radiated form the number of panels to the set of choke flange assemblies According to a further preferred embodiment, the RF seal assembly is arranged at a hinge line of the antenna system.

The RF seal assembly can be regarded as a choke configuration that is used to close the gaps between panels, i.e. tiles within the panels.

BRIEF DESCRIPTION OF THE DRAWING FIGURES

More details and advantages of the invention will be described by reference to the accompanying figures.

In the figures, like elements are depicted with like reference numerals. It is to be noted that the embodiments shown in the figures are not drawn to scale and are used to illustrate the basic concept of the invention.

DETAILED DESCRIPTION

An RF seal assembly, as described below, is intended to be used in an antenna system for space-borne applications, for example the Sentinel-1 SAR Antenna Subsystem (SAS) for the Sentinel-1 mission. This antenna system is, as known to a skilled person, a deployable planar active phased array antenna working in C-band (5.405 GHz) with a frequency bandwidth of 100 MHz. The antenna is formed by a central panel mounted on top of the spacecraft and two antenna side wings at the two adjacent sides of the spacecraft. The central panel is equipped with two SAS tiles, whereas the two panels of each side wing carry three SAS tiles each. This leads to an overall number of 14 identical tiles. Each SAS tile possesses all the functions needed to allow for beam shaping and steering.

Figure 3:
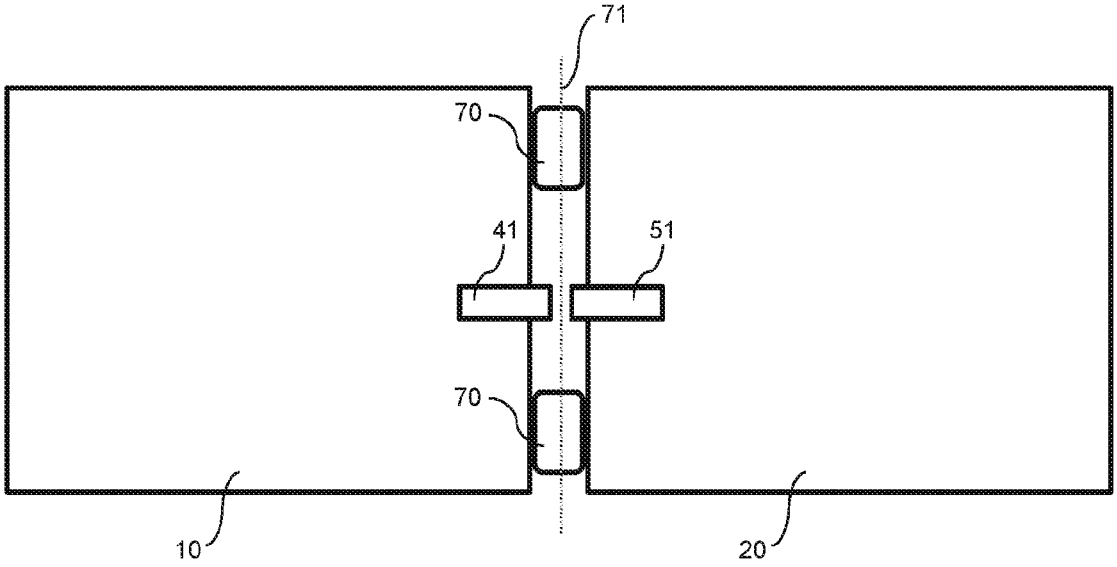
FIG. 3 shows a plan view of an RF seal assembly for use in a space-borne antenna system according to the invention.

Each of the number of panels is movable to each other. During transport of the antenna system to space, the panels are folded by means of hinges, due to space reasons. In orbit, they are deployed. As shown in FIG. 3, the connection of two adjacent panels 10, 20 by means of a hinge 70 results in a small gap between the adjacent panels when the panels are arranged in an operation condition, i.e. when all of the panels are arranged in a common plane. A signal transmission coupling between two adjacent panels is realized by means of a choke flange assembly consisting of a first waveguide in one of the panels and a second waveguide in one of the other panels. The first and the second waveguide are affixed in opposing pairs to enable contactless signal transmission over the gap.

The detailed composition of this type of antenna system is known to the person skilled in the art, such as from the above mentioned Sentinel-1 SAR antenna, so that further explanations with respect to details of the antenna system will be omitted.

Figure 1:
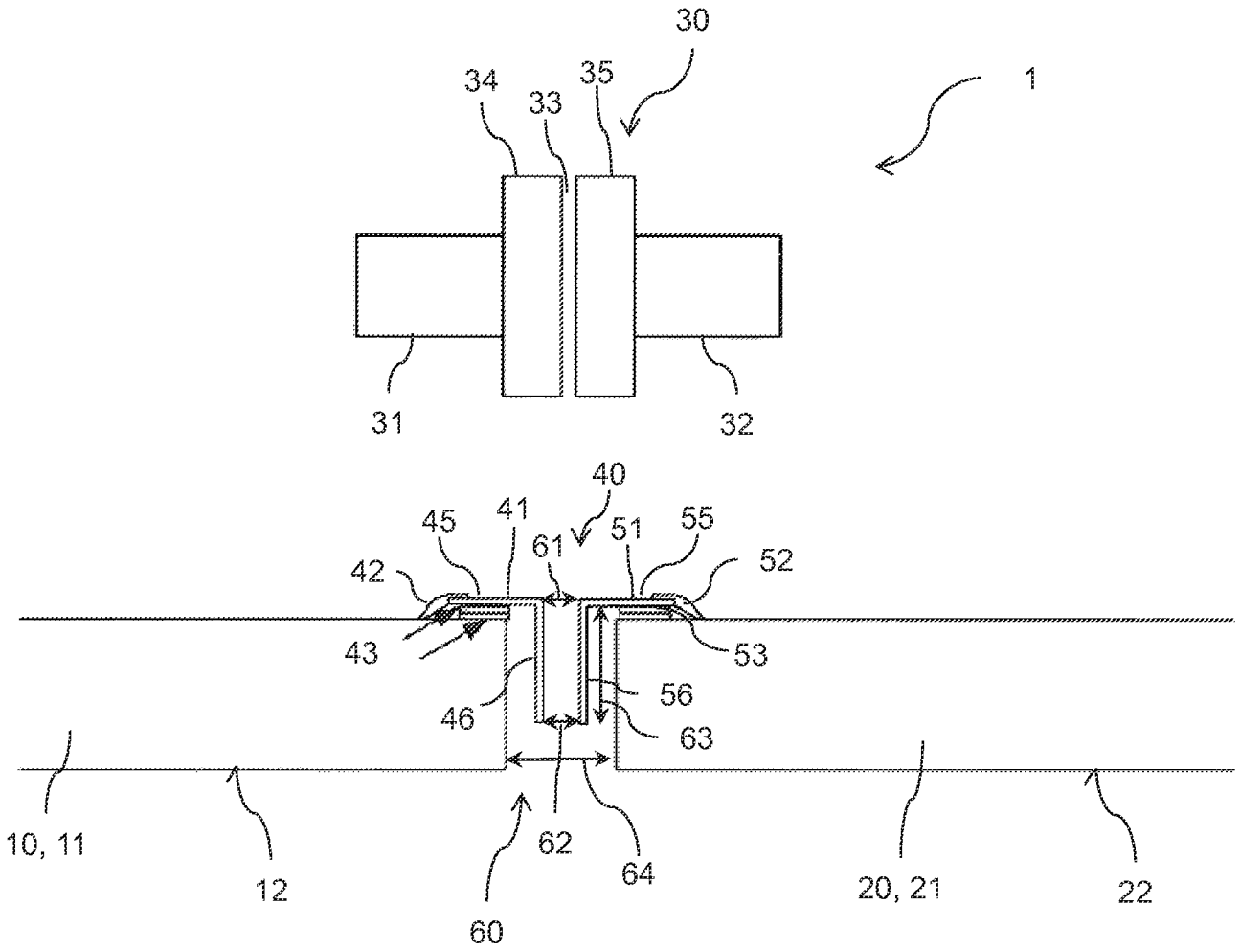
FIG. 1 shows a first embodiment of an RF seal assembly for use in a space-borne antenna system according to the invention.

Referring now to FIG. 1, a part of an antenna system 1 of the type described above is illustrated in the region of two neighboring panels, a first of which is depicted with 10 and a second of which is depicted with 20. As noted above, each of the panels 10, 20 consists of a number of tiles. A tile of the first panel 10 is depicted with 11, a the of the second panel is depicted with 21. The tiles 11, 21 are located adjacent to each other. A gap between the first panel 10 and the second panel 20 and the first tile 11 and the second tile 21, respectively, is depicted with 60. The gap 60 has a length 64 which typically is around 5 mm. In the figure, radiating surfaces 12, 22 of the first and second panel and tile 11, respectively, are directed downwards in the plane of drawing.

To enable contactless inter-panel communication, a choke flange assembly 30 is arranged on the far side of the radiating surfaces of the dedicated adjacent panels 10, 20. The choke flange assembly 30 consists of a first waveguide 31 which is embedded in a (not shown) housing of the first panel 10 and a second waveguide 32 which is embedded in a (not shown) housing of the second panel 20. In between the first and the second waveguides 31, 32, there is a gap 33. Flanges 34, 35 of the first and the second waveguide 31, 32 are located (at least partly) within the gap 60.

To suppress signal coupling of signals radiated from the panels 10, 20 and their tiles 11, 21, respectively, an RF seal assembly 40 is provided within the gap 60. The RF seal assembly 40 consists of a first seal profile 41 attached to the first panel 10 and a second seal profile 51 attached to the second panel 20. The RF seal assembly 40 is provided to seal the gap 60 at least partly.

In a cross-section, i.e. in a side view in a longitudinal section through the antenna system 1, the first and the second seal profile 41, 51 have the shape of an "L". A respective first portion 45, 55 of the first and second seal profile 41, 51 extends in the plane of the panels 10, 20 (i.e. in a direction perpendicular to the plane of drawing from the left side to the right side) into the gap 60. A respective second portion 46, 56 of the first and second seal profile 41, 51 extends in a direction of radiation of signals radiated from the panels 10, 20 (i.e. in a direction perpendicular to the plane of drawing top down). The length of the second portions 46, 56 is a quarter of the wavelength of the signals radiated from the panels 10, 20.

A respective first portion 45, 55 of the first and second seal profile 41, 51 is attached to the dedicated panel 10, 20 by means of adhesive tape 43, and 53. The attachment of a respective first portion 45, 55 of the first and second seal profile 41, 51 to the dedicated panel 10, 20 may be made by an adhesive tape and/or epoxy glue. Moreover, the seal profiles 41, 51 are electrically coupled to the dedicated panel 10, 20 by means of a conductive foil 42, 52, such as an so-called cho-foil, which is known from prior art as well.

The first and the second seal profile 41, 51 are arranged in opposing pairs in the gap 60 to seal the gap at least partly. In the plane of the first portions 45, 55 of the first and second seal profiles 41, 51, there is a gap 61 having a first length between the seal profiles 41, 51. At the outside ends of the second portions 46, 56, directed to the radiating surfaces 12, 22, there is a gap 62 having a second length between the seal profiles 41, 51. In the first embodiment, shown in FIG. 1, the first length of gap 61 corresponds to the second length of the gap 62. That means the second portions 46, 56 are parallel to each other. The length of the first and the second gap 61, 62 may be around 0.8 mm to 1 mm.

Figure 2:
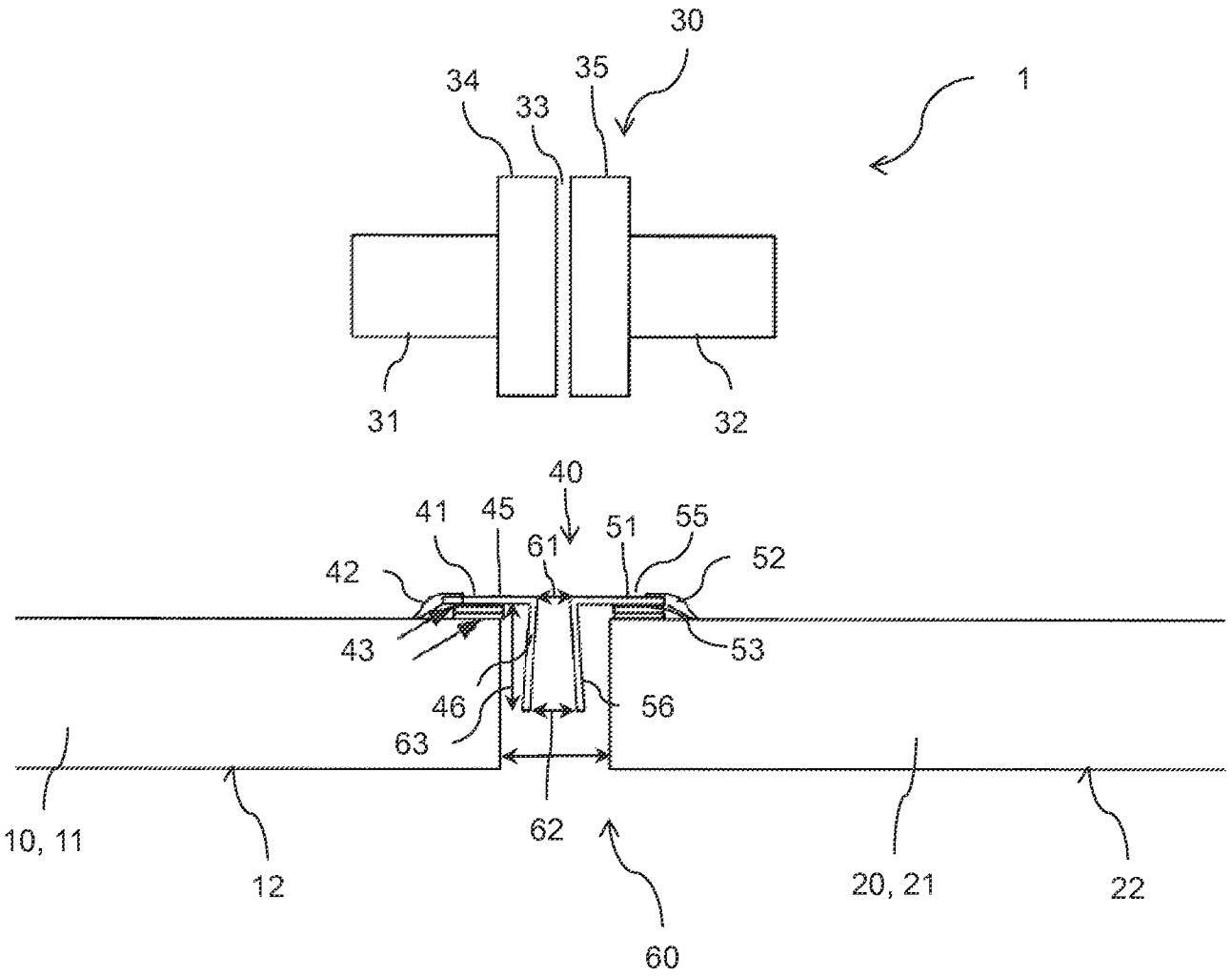
FIG. 2 shows a second embodiment of an RF seal assembly for use in a space-borne antenna system according to the invention.

In the second embodiment, shown in FIG. 2, the first length of the gap 61 is smaller than the second length of the gap 62. As a result, the gap between the second portions has a widening width in a direction of radiation of signals, i.e. the angle between the first and the second portions 45, 46; 55, 56 of a respective seal profile 41, 51 is less than 90°. The length of the gap 61 may be around 0.8 mm. The length of the gap 62 may be around 1.2 mm. The remainder of the configuration of the second embodiment, shown in FIG. 2, corresponds to the first embodiment, shown in FIG. 1. However, in an alternative embodiment the angle between the first and the second portion 45, 46; 55, 56 may be greater than 90°.

The first and second seal profiles 41, 51 may be made from the material of the radiating waveguides of the panels 10, 20. This ensures that the RF seal assembly and the waveguides have same coefficients of thermal expansion and minimizes thereto-mechanical stress. Hence, the first and the second seal profiles may be made from CFRP (carbon fiber reinforced plastic), which has a metallization on its surface. For example, the first and the second seal profiles 41, 51 made from CFRP may be copper plated. This allows manufacturing the profiles from left-over waveguides. Alternatively, the seal profiles 41, 51 of the RF seal assembly 40 may be made from a metal, e.g. aluminum.

As shown in FIG. 3, the RF seal assembly may be attached to the panel-to-panel junctions at the hinge line 71.

The effect of the RF seal assembly, i.e. a significant suppression of signal coupling of signals radiated from the panels 10, 20 to the choke flange 30, has been verified with an S-parameter test.

As will be realized by a skilled person, the RF seal assembly 40 is contactless in the sense that the first and the second seal profile 41, 51 do not have any mechanical contact to each other. The configuration of the first and the second seal profile 41, 51 is such that it does not counter-act to the panel latching mechanism, i.e. no excessive additional mechanical force is exerted.

As a further advantage the RF seal assembly does not a mechanical contact between the panels 10, 20.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE SIGNS

1 antenna system
10 first panel
11 tile of first panel
12 radiating surface of tile 11
20 second panel
21 tile of second panel
22 radiating surface of tile 21
30 choke flange assembly
31 first waveguide
32 second waveguide
33 gap between first and second waveguide
34 flange of the first waveguide 31
35 flange of the second waveguide 32
40 RF seal assembly
41 first seal profile
42 conductive foil
43 adhesive tape
45 first portion of first seal profile extending in a plane of the panel into the gap 60
46 second portion of first seal profile extending in a direction of radiation of signals
51 second seal profile
52 conductive foil
53 adhesive tape
55 first portion of second seal profile extending in a plane of the panel into the gap 60
56 second portion of second seal profile extending in a direction of radiation of signals
60 gap between first and second panel
61 gap between first and second seal profile
62 gap between first and second seal profile at outside ends of portions 45, 55
63 length of portions 45, 55 of first and second profile
64 length of gap 60 between first and second panel

What is claimed is:

1. A space-borne antenna system, comprising:

a number of panels in an operational position in which there is a gap between the number of panels;

a choke flange assembly configured to transmit inter-panel signals across the gap; and an RF seal assembly configured to suppress a signal coupling of signals radiated from the number of panels to the choke flange assembly by sealing the gap;

wherein the RF seal assembly is arranged at a hinge line and comprises a first seal profile and a second seal profile that are affixed as an opposing pair in the gap between the number of panels;

wherein the first seal profile and the second seal profile each comprise a first portion which is attached to a respective panel.

2. The antenna system of claim 1, wherein the RF seal assembly is dedicated to the gap between the number of panels.

3. The antenna system of claim 1, wherein the first and the second seal profiles are L-shaped, in a side view in a longitudinal section through the antenna system.

4. The antenna system of claim 3, wherein first portions of the first and the second seal profiles extend when the number of panels are arranged in the operation condition in a plane of the number of panels.

5. The antenna system of claim 1, wherein second portions of the first and the second seal profiles extend in a direction of radiation of signals such that the second portions of the first and second seal profiles are opposing and have a gap in between them.

6. The antenna system of claim 5, wherein the gap between the second portions of the first and the second seal profiles has a constant width in the direction of radiation of signals.

7. The antenna system of claim 5, wherein the gap between the second portions of the first and the second seal profile has a widening or narrowing width in the direction of radiation of signals.

8. The antenna system of claim 1, wherein the number of panels comprise radiation waveguides; and the RF seal assembly and the radiating waveguides of the number of panels are made from a same material.

9. The antenna system of claim 1, wherein the RF seal assembly is mechanically attached to the number of panels via at least one adhesive tape.

10. The antenna system of claim 1, wherein the RF seal assembly is electrically coupled to the number of panels via a metal adhesive tape.

11. The antenna system of claim 1, wherein the number of panels are configured to move between a first position and a second position, wherein the second position is the operational position.

12. A space-borne antenna system, comprising:

a number of panels configured to move by means of a hinge between a first position and a second position, wherein the second position is an operational position in which there is a gap between the number of panels;

a choke flange assembly configured to transmit inter-panel signals across the gap; and an RF seal assembly configured to suppress a signal coupling of signals radiated from the number of panels to the choke flange assembly, wherein the RF seal assembly is arranged at a hinge line of the hinge.

13. A space-borne antenna system, comprising:

a number of panels in an operational position in which there is a gap between the number of panels;

a choke flange assembly configured to transmit inter-panel signals across the gap; and an RF seal assembly configured to suppress a signal coupling of signals radiated from the number of panels to the choke flange assembly by sealing the gap, wherein the RF seal assembly comprises a first seal profile and a second seal profile that are affixed as an opposing pair in the gap between the number of panels, wherein the first seal profile and the second seal profile each comprise a first portion which is attached to a respective panel, and wherein the first and the second seal profiles are L-shaped, in a side view in a longitudinal section through the antenna system.

* * * * *